US005488025A

United States Patent [19]

Martin et al.

[11] Patent Number: 5,488,025

[45] Date of Patent: Jan. 30, 1996

[54] DYE-RECEIVING ELEMENT CONTAINING ELASTOMERIC BEADS IN OVERCOAT LAYER FOR THERMAL DYE TRANSFER

[75] Inventors: Thomas W. Martin, Rochester; William H. Simpson, Pittsford; Jacob J. Hastreiter, Jr., Spencerport, all of N.Y.

[73] Assignee: Eastman Kodak Company, Rochester, N.Y.

[21] Appl. No.: 473,805

[22] Filed: Jun. 7, 1995

[51] Int. Cl.[6] ..... B41M 5/035; B41M 5/38

[52] U.S. Cl. ..... 503/227; 428/195; 428/206; 428/327; 428/913; 428/914

[58] Field of Search ..... 428/195, 206, 428/327, 913, 914; 503/227; 8/471

[56] References Cited

U.S. PATENT DOCUMENTS 5,187,146 2/1993 Ficcaglia et al. ..... 503/227

*Primary Examiner*—B. Hamilton Hess
*Attorney, Agent, or Firm*—Harold E. Cole

[57] ABSTRACT

A dye-receiving element comprising a reflective support having thereon a dye image-receiving layer having an overcoat layer thereon containing crosslinked elastomeric beads having a Tg of 45° C. or less, the elastomeric beads being made from an acrylic polymer, an acrylic copolymer or a styrenic copolymer, the elastomeric beads having from about 5 to about 40% by weight of a crosslinking agent, the elastomeric beads having a particle size of less than about 1 μm and are present at a coverage of from about 0.2 to about 1.0 g/m$^2$.

12 Claims, No Drawings

DYE-RECEIVING ELEMENT CONTAINING ELASTOMERIC BEADS IN OVERCOAT LAYER FOR THERMAL DYE TRANSFER

This invention relates to a dye-receiving element used in thermal dye transfer, and more particularly to a reflective support dye-receiving element containing elastomeric beads in an overcoat layer for gloss reduction.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Reflective dye-receiving elements available for thermal dye transfer printing can comprise a reflective support made by laminating a packaging film to the image side of a paper stock to provide good image uniformity. This laminate is then coated with a dye-receiving layer for accepting the imaging dyes provided by the dye-donor element. The laminate is then provided with an overcoat layer to protect against sticking of the dye-receiving element to the dye-donor element during printing.

For certain applications the high gloss level obtained with such dye-receiver elements may not be a desirable feature. In fact, there are many applications in the printing and publishing industry where a low-gloss dye-receiving element is a requirement. Nevertheless, such a low-gloss dye-receiving element would still have to yield a print uniformity close to that of a high-gloss receiver to gain acceptance in the marketplace.

Prior approaches to gloss control for reflective supports include a post-print roughening of the dye image-receiving layer as described in JP 2- 003057 or use of an intermediate cushion layer between the support and the dye image-receiving layer of a dye-receiving element as described in U.S. Pat. No. 5,300,398. Both of these approaches require additional process steps or layers to be coated during the manufacturing process which are cumbersome and expensive.

JP 60/38192 discloses the incorporation of microparticles into a thermal recording receiving element for improved storage and abrasion resistance of the printed images. This Kokai teaches that the particles should have a glass transition temperature (Tg) above 80° C.

JP 6/286351 discloses a dye-receiving element containing "functional group modified silicone rubber elastic micron-sized particles" to prevent blocking or sticking to a dye-donor element during processing.

It is an object of this invention to provide a dye image-receiving element containing elastomeric particles which has improved printing uniformity. It is another object of this invention to provide a dye image-receiving element containing elastomeric particles which result in gloss control characteristics.

These and other objects are achieved in accordance with the invention, which comprises a dye-receiving element comprising a reflective support having thereon a dye image-receiving layer having an overcoat layer thereon containing crosslinked elastomeric beads having a Tg of 45° C. or less, the elastomeric beads being made from an acrylic polymer, an acrylic copolymer or a styrenic copolymer, the elastomeric beads having from about 5 to about 40% by weight of a crosslinking agent, the elastomeric beads having a particle size of less than about 1 μm and are present at a coverage of from about 0.2 to about 1.0 g/m$^2$.

In contrast to prior art microbeads for dye-receivers which are harder and have a higher Tg, it has been found that the elastomeric microbeads of the invention which have a lower Tg are compressed under the weight of the thermal print head during printing, thereby allowing better contact between the dye-donor and dye-receiver elements. When microbeads having a high Tg are used, the microbeads are too rigid and prevent intimate contact between the dye-donor and dye-receiver during printing, resulting in image mottle and poor image quality. The improved dye-donor/dye-receiver contact achievable with the low Tg elastomeric microbeads of the invention results in reduced mottle and improved image quality. As noted above, the crosslinked elastomeric beads employed in the invention have a Tg of 45° C. or less, preferably 10° C. or less.

Microbead elasticity is determined by the amount of crosslinking agent employed in making the microbead. If the amount of crosslinking agent used is too high, the microbeads produced will be too rigid and will not be deformed under the pressure exerted by the thermal print head during printing, which leads to mottle and poor image quality. If the amount of crosslinking agent in the microbeads is too low, the microbeads will not only be deformed under the pressure exerted by the thermal print head, but will also undergo nonelastic flow leading to permanent deformation, making recovery of their original shape impossible. Dye-receivers containing such particles will then be less effective in scattering incident light upon the dye-receiver, thus being less effective in reducing gloss.

Thus, the elastomeric microbeads used in the invention have a combination of both the proper Tg and level of crosslinking agent in order to achieve the desired degree of elasticity.

As noted above, the elastomeric microbeads generally have a particle size of less than about 1 μm. If the elastomeric microbeads have a particle size of greater than about 1 μm, they will be less effective in scattering incident light upon the dye-receiver and will be less effective in reducing gloss of the dye-receiver.

As noted above, the elastomeric microbeads are present at a coverage of from about 0.2 to about 1.0 g/m$^2$. If the microbeads are present at a coverage of less than about 0.2 g/m$^2$, there is less light scattering at the dye-receiver layer surface, thus there is less effect on gloss reduction. If the microbeads are present at a coverage of greater than about 1.0 g/m$^2$, the coating uniformity is unacceptable.

As described above the elastomeric beads used in the invention are made from an acrylic polymer or copolymer, such as butyl-, ethyl-, propyl-, hexyl-, 2-ethyl hexyl-, 2-chloroethyl-, 4-chlorobutyl- or 2 -ethoxyethyl- acrylate or methacrylate; acrylic acid; methacrylic acid, hydroxyethyl acrylate, etc.; or a styrenic copolymer, such as styrene-butadiene, styrene-acrylonitrile-butadiene, styrene-isoprene, hydrogenated styrene-butadiene, etc., or mixtures thereof.

The elastomeric beads may be crosslinked with various crosslinking agents, which may also be part of the elastomeric copolymer, such as divinylbenzene; ethylene glycol diacrylate; 1,4-cyclohexylene-bis(oxyethyl) dimethacrylate; 1,4-cyclohexylene-bis(oxypropyl) diacrylate; 1,4-cyclohexylene-bis(oxypropyl) dimethacrylate; ethylene glycol diacrylate; etc.

The glass transition temperatures referred to below were determined by the method of differential scanning calorimetry (DSC) at a scanning rate of 20° C./minute and the onset in the change in heat capacity was taken as the Tg.

Following are examples of typical elastomeric microbeads which may be employed in the invention:

Bead 1) EXL3691 beads of a methyacrylate-butadiene-styrene copolymer core with a poly(methyl methacrylate) shell (Rohm and Haas Co.) having a nominal diameter of approximately 0.15 μm and a Tg of approximately −76° C.

Bead 2) EXL3330 beads of a methyacrylate-butadiene-styrene copolymer core with a poly(methyl methacrylate) shell (Rohm and Haas Co.) having a nominal diameter of approximately 0.60 μm and a Tg of approximately −33° C.

Bead 3) poly(butyl acrylate-co-divinylbenzene) (80:20 mole ratio) having a nominal diameter of approximately 0.5 μm and a Tg of approximately −31° C.

Bead 4) poly(styrene-co-butyl acrylate-co-divinylbenzene) (40:40:20 mole ratio) having a nominal diameter of approximately 0.2 μm and a Tg of approximately 45° C.

Bead 5 ) poly(ethyl acrylate-co-ethylene glycol diacrylate) (90:10 mole ratio) having a nominal diameter of approximately 0.7 μm and a Tg of approximately −22° C.

Bead 6) poly(2-ethylhexyl acrylate-co-styrene-co-divinylbenzene) (45:40:15 mole ratio) having a nominal diameter of approximately 0.6 μm and a Tg of approximately 20° C.

Bead 7) poly[2-chloroethylacrylate-co-1,4 -cyclohexylene-bis(oxypropyl) diacrylate](80:20 mole ratio) having a nominal diameter of approximately 0.3 μm and a Tg of approximately −10° C.

Bead 8) poly(butyl methacrylate-co-hydroxyethyl-acrylate-co-divinylbenzene) (65:10:25 mole ratio) having a nominal diameter of approximately 0.2 μm and a Tg of approximately 29° C.

Bead 9) poly(styrene-co-butadiene-co-divinylbenzene) (40:50:10 mole ratio) having a nominal diameter of approximately 0.3 μm and a Tg of approximately −55° C.

Bead 10) poly(styrene-co-2-ethyoxyethyl acrylate-co-ethylene glycol diacrylate)(20:45:35 mole ratio) having a nominal diameter of approximately 0.2 μm and a Tg of approximately −5° C.

Bead 11) poly(styrene-co-hexyl acrylate-co-divinylbenzene) (10:70:20 mole ratio) having a nominal diameter of approximately 0.4 μm and a Tg of approximately −15° C.

Bead 12) polybutadiene crosslinked with divinylbenzene(80:20)having a nominal diameter of approximately 0.8 μm and a Tg of approximately −30° C.

The dye image-receiving layer of the receiving elements of the invention may comprise, for example, a polycarbonate, a polyurethane, a polyester, polyacrylate, poly(vinyl chloride), poly(styrene-co-acrylonitrile), polycaprolactone or mixtures thereof. The dye image-receiving layer may be present in any amount which is effective for the intended purpose. In general, good results have been obtained at a concentration of from about 1 to about 10 g/m$^2$.

The support for the dye-receiving element of the invention is reflective, and may comprise a polymeric, a synthetic paper, or a cellulosic paper support, or laminates thereof. The support may be employed at any desired thickness, usually from about 10 μm to 1000 μm. Additional polymeric layers may be present between the support and the dye image-receiving layer. For example, there may be employed a polyolefin such as polyethylene or polypropylene. White pigments such as titanium dioxide, zinc oxide, etc., may be added to the polymeric layer to provide reflectivity. In addition, a subbing layer may be used over this polymeric layer in order to improve adhesion to the dye image-receiving layer. Such subbing layers are disclosed in U.S. Pat. Nos. 4,748,150, 4,965,238, 4,965,239, and 4,965,241, the disclosures of which are incorporated by reference. The receiver element may also include a backing layer such as those disclosed in U.S. Pat. Nos. 5,011,814 and 5,096,875, the disclosures of which are incorporated by reference. In a preferred embodiment of the invention, the support comprises a microvoided thermoplastic core layer coated with thermoplastic surface layers as described in U.S. Pat. No. 5,244,861, the disclosure of which is hereby incorporated by reference.

Dye-donor elements that are used with the dye-receiving element of the invention conventionally comprise a support having thereon a dye layer comprising a dye dispersed in a binder. Any dye can be used in the dye-donor employed in the invention provided it is transferable to the dye-receiving layer by the action of heat. Especially good results have been obtained with sublimable dyes. Dye-donor elements applicable for use in the present invention are described, e.g., in U.S. Pat. Nos. 4,916,112, 4,927,803 and 5,023,228, the disclosures of which are incorporated by reference.

As noted above, dye-donor elements are used to form a dye transfer image. Such a process comprises imagewise heating a dye-donor element and transferring a dye image to a dye-receiving element as described above to form the dye transfer image.

In a preferred embodiment of the invention, a dye-donor element is employed which comprises a poly(ethylene terephthalate) support coated with sequential repeating areas of cyan, magenta and yellow dye, and the dye transfer steps are sequentially performed for each color to obtain a three-color dye transfer image. Of course, when the process is only performed for a single color, then a monochrome dye transfer image is obtained.

Thermal printing heads which can be used to transfer dye from dye-donor elements to the receiving elements of the invention are available commercially. There can be employed, for example, a Fujitsu Thermal Head (FTP-040 MCS001), a TDK Thermal Head F415 HH7-1089 or a Rohm Thermal Head KE 2OO8-F3. Alternatively, other known sources of energy for thermal dye transfer may be used such as lasers.

A thermal dye transfer assemblage of the invention comprises (a) a dye-donor element, and (b) a dye-receiving element as described above, the dye-receiving element being in a superposed relationship with the dye-donor element so that the dye layer of the donor element is in contact with the dye image-receiving layer of the receiving element.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The following examples are provided to further illustrate the invention.

EXAMPLE 1

Gloss Characteristics as a Function of Bead Size

A series of dye-receiver elements was prepared and provided with overcoats according to the present invention containing elastic beads of different sizes. In particular, a paper stock consisting of a blend of alpha and maple pulps with a microvoided packaging film laminated to the imaging side was coated with a dye-receiving layer consisting of a blend of components as described in U.S. Pat. No. 5,262,378, col. 6, lines 14–28.

The dye-receiving layer was overcoated with the sample dispersions comprising binder, beads, and additives as shown below.

The binder used for all sample dispersions was the following polycarbonate:

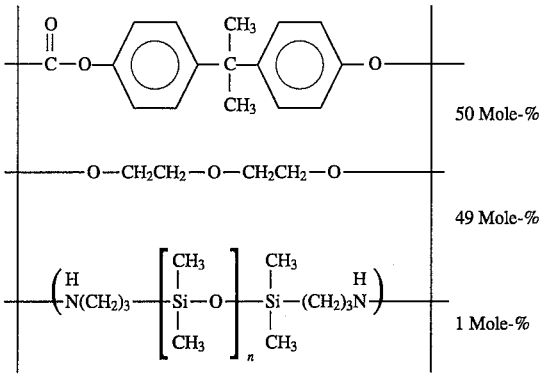

where n is ~55–65

A linear condensation polymer considered to be derived from carbonic acid, bisphenol A, diethylene glycol, and aminopropyl-terminated polydimethyl-siloxane.

Control Dye-receiver C-1 containing an overcoat layer composition which did not contain any beads, coated from dichloromethane, was applied to the dye image-receiving layer of the above-described dye-receiver which contained the polycarbonate binder (0.65 g/m$^2$), Fluorad FC-431®, a perfluoroamido surfactant, (3M Corp.) (0.02 g/m$^2$) and DC-510® (0.02 g/m$^2$) a silicone fluid surfactant (Dow-Corning Co.).

Dye-receiver elements according to the invention were prepared similar to the control dye-receiver element C-1 except that the overcoat layer contained:

E-1: Bead 1 (0.65 g/m$^2$)
E-2: Bead 2 (0.48 g/m$^2$)
E-3: Bead 1 (0.32 g/m$^2$)

Control dye-receiver elements were prepared similar to control element C-1 except that they contained the following beads having a particle size greater than 1 μm and/or are nonelastic: C-2: EXL5137 acrylic terpolymer microbeads (Rohm & Haas Co.) having a nominal diameter of approximately 6 to 8 μm and a Tg of approximately −33° C. (0.11 g/m$^2$). C-3: poly(styrene-co-butyl acrylate-co-divinylbenzene) (40:40:20 mole ratio) having a nominal diameter of approximately 4 μm and a Tg of approximately 45° C. (0.11 g/m$^2$). C-4: poly(butyl acrylate-co-divinylbenzene) (80:20 mole ratio) having a nominal diameter of approximately 4 μm and a Tg of approximately −31° C. (0.11 g/m$^2$). C-5: a nonelastic, hard microbead composed of divinylbenzene having a nominal diameter of approximately 4 μm (0.11 g/m$^2$).

The gloss of the dye-receiver elements was determined at 20 and 60 degrees, respectively, with a Gardener Micro-Tri-Gloss meter according to ASTM Standard Test Method for Specular Gloss (D-523-89). The results are shown as follows:

TABLE 1

| Sample | 20° gloss | 60° gloss |
|---|---|---|
| C-1 | 67 | 92 |
| C-2 | 46 | 76 |
| C-3 | 44 | 73 |
| C-4 | 42 | 71 |
| C-5 | 43 | 72 |
| E-1 | 4 | 26 |
| E-2 | 19 | 66 |
| E-3 | 7 | 40 |

The above data show that the gloss of dye-receivers can be controlled by incorporating microbeads according to the invention into the protective overcoat layer.

EXAMPLE 2

Print Uniformity

The above dye-receivers were then subjected to testing of the resulting print uniformity achievable with them. Three-color dye-donor elements were prepared and printed as described in U.S. Pat. No. 5,262,378, col. 6, line 42 through col. 8, line 28, and used to print test samples for measurement of Status A Neutral Reflection Densities. Visual observation of image defects, such as mottle, white spots, drop-outs were made. The data obtained are summarized in Table 2 below.

Each sample tested was supplied with sufficient thermal energy from the thermal head to print areas of about 2 cm$^2$ with nominal neutral Status A reflection densities of 0.65 (Area 1), 0.30 (Area 2), 0.20 (Area 3) and 0.10 (Area 4), areas of high density down to low density. The densities were read with an X-Rite Densitometer®, (X-Rite Corp. Grandville, Mich.) at five points within each area and averaged. It is desirable to have dye densities in the dye-receivers with beads be as close as possible to the C-1 dye-receiver element without beads in Area 4, the low density or highlight area, in order to accurately reproduce low optical density details in a print.

In addition, the print quality of each test sample was visually judged with a rating of 1=no defects observed, 2=some defects observed, marginal print quality and 3=unacceptable print. The following results were obtained:

TABLE 2

| | Status A Neutral Reflection Density | | | | Defects |
|---|---|---|---|---|---|
| Sample | Area 1 | Area 2 | Area 3 | Area 4 | Estimated |
| C-1 | 0.71 | 0.32 | 0.22 | 0.13 | 1 |
| C-2 | 0.67 | 0.29 | 0.19 | 0.07 | 2 |
| C-3 | 0.69 | 0.29 | 0.16 | 0.07 | 2 |
| C-4 | 0.68 | 0.29 | 0.15 | 0.07 | 2 |
| C-5 | 0.67 | 0.29 | 0.07 | 0.07 | 3 |
| E-1 | 0.66 | 0.28 | 0.18 | 0.11 | 1 |
| E-2 | 0.67 | 0.30 | 0.21 | 0.13 | 1 |
| E-3 | 0.67 | 0.30 | 0.19 | 0.11 | 1 |

The above results show that dye-receivers containing microbeads in accordance with the invention have no print defects in comparison to the control dye-receivers C-2 through C-5 which had several defects. (C-1 which had no beads had no print defects as expected).

The above results also show that low density Area 4 is unaffected by the addition of microbeads in accordance with the invention (E-1, E-2 and E-3 as compared to C-1), while the Control dye-receivers C-2, C-3, C-4 and C-5 had lower density measurements in that area, so that details in those prints would be lost.

The invention has been described in detail with particular reference to preferred embodiments thereof, but it will be understood that variations and modifications can be effected within the spirit and scope of the invention.

What is claimed is:

1. A dye-receiving element comprising a reflective support having thereon a dye image-receiving layer, said dye image-receiving layer having an overcoat layer thereon containing crosslinked elastomeric beads having a Tg of 45° C. or less, said elastomeric beads being made from an acrylic polymer, an acrylic copolymer or a styrenic copolymer, said elastomeric beads having from about 5 to about 40% by weight of a crosslinking agent, said elastomeric beads having a particle size of less than about 1 μm and are present at a coverage of from about 0.2 to about 1.0 g/m$^2$.

2. The element of claim 1 wherein said elastomeric beads have a Tg of 10° C. or less.

3. The element of claim 1 wherein said elastomeric beads are made of poly(butyl acrylate-co-divinylbenzene).

4. The element of claim 1 wherein said elastomeric beads are made of poly(styrene-co-butyl acrylate-co-divinylbenzene).

5. A process of forming a dye transfer image comprising:

a) imagewise-heating a dye-donor element comprising a support having thereon a dye layer comprising a dye dispersed in a binder, and b) transferring a dye image to a dye-receiving element comprising a reflective support having thereon a dye image-receiving layer to form said dye transfer image, wherein said dye image-receiving layer has an overcoat layer thereon containing crosslinked elastomeric beads having a Tg of 45° C. or less, said elastomeric beads being made from an acrylic polymer, an acrylic copolymer or a styrenic copolymer, said elastomeric beads having a particle size of less than about 1 μm and are present at a coverage of from about 0.2 to about 1.0 g/m$^2$.

6. The process of claim 5 wherein said elastomeric beads have a Tg of 10° C. or less.

7. The process of claim 5 wherein said elastomeric beads are made of poly(butyl acrylate-co-divinylbenzene).

8. The process of claim 5 wherein said elastomeric beads are made of poly(styrene-co-butyl acrylate-co-divinylbenzene).

9. A thermal dye transfer assemblage comprising:

a) a dye-donor element comprising a support having thereon a dye layer comprising a dye dispersed in a binder, and b) a dye-receiving element comprising a reflective support having thereon a dye image-receiving layer, said dye-receiving element being in a superposed relationship with said dye-donor element so that said dye layer is in contact with said dye image-receiving layer, wherein said dye image-receiving layer has an overcoat layer thereon containing crosslinked elastomeric beads having a Tg of 45° C. or less, said elastomeric beads being made from an acrylic polymer, an acrylic copolymer or a styrenic copolymer, said elastomeric beads having from about 5 to about 40% by weight of a crosslinking agent, said elastomeric beads having a particle size of less than about 1 μm and are present at a coverage of from about 0.2 to about 1.0 g/m$^2$.

10. The assemblage of claim 9 wherein said elastomeric beads have a Tg of 10° C. or less.

11. The assemblage of claim 9 wherein said elastomeric beads are made of poly(butyl acrylate-co-divinylbenzene).

12. The assemblage of claim 9 wherein said elastomeric beads are made of poly(styrene-co-butyl acrylate-co-divinylbenzene).

* * * * *